US007343773B1

(12) United States Patent
Chan

(10) Patent No.: US 7,343,773 B1
(45) Date of Patent: Mar. 18, 2008

(54) REPAIRING KIT FOR AUTOMOTIVE DENTS

(76) Inventor: Yi-Chang Chan, 3F, No. 82-3, Sec. 1, Kuang Fu Rd., San Chung City, Taipei Hsien (TW)

( * ) Notice: Subject to any disclaimer, the term of this patent is extended or adjusted under 35 U.S.C. 154(b) by 0 days.

(21) Appl. No.: 11/599,011

(22) Filed: Nov. 13, 2006

(51) Int. Cl.
*B21J 13/03* (2006.01)

(52) U.S. Cl. ..... 72/479; 72/482.92; 72/705

(58) Field of Classification Search ..... 72/457, 72/458, 477, 478, 479, 481.6, 481.7, 481.8, 72/482.92, 705
See application file for complete search history.

(56) References Cited

U.S. PATENT DOCUMENTS

| | | | | |
|---|---|---|---|---|
| 2,900,853 | A * | 8/1959 | Steck | 72/457 |
| 2,941,429 | A * | 6/1960 | Mason | 72/457 |
| 3,113,478 | A * | 12/1963 | Hall, Jr. et al. | 72/458 |
| 4,034,594 | A * | 7/1977 | Morgan | 72/457 |
| 6,874,347 | B2 * | 4/2005 | Meichtry | 72/458 |

* cited by examiner

*Primary Examiner*—Ed Tolan
(74) *Attorney, Agent, or Firm*—Pro-Techtor Int'l Services

(57) ABSTRACT

A repairing kit for automotive dents structured from a straight bar, a connecting tube, a handle, an impact piece, a clamp mount and repair members, which can be used to repair automotive dents and restore a smooth surface to an automobile using a DIY method, without damaging the baking finish surface after repairing the automotive dent.

2 Claims, 4 Drawing Sheets

REPAIRING KIT FOR AUTOMOTIVE DENTS

BACKGROUND OF THE INVENTION (a) Field of the Invention

The present invention relates to a repairing kit for automotive dents, and more particularly to a repairing kit that can be used to completely repair auto body cavities by a DIY method.

(b) Description of the Prior Art

Dents are created on a general automobile when the automobile is hit by small rocks or foreign objects. An owner of the car cannot repair by a DIY (Do It Yourself) method, and relies on an auto repair shop to repair the dents. Nevertheless, the majority of repair procedures taken by the auto repair shop include first hammering out the automotive dent cavity to restore it to a smooth surface, and then implementing a baking finish on the surface of the car body, which is both time consuming and very troublesome.

There are a few USA patents that mention a repairing kit for automotive dents, including U.S. Pat. Nos. 1,457,570, 169,646, 5,203,196 and 5,934,139, nevertheless, all the above mentioned patents are different from the present invention.

SUMMARY OF THE INVENTION

The primary object of the present invention is to provide a repairing kit that can be used to repair automotive dents by a DIY method.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
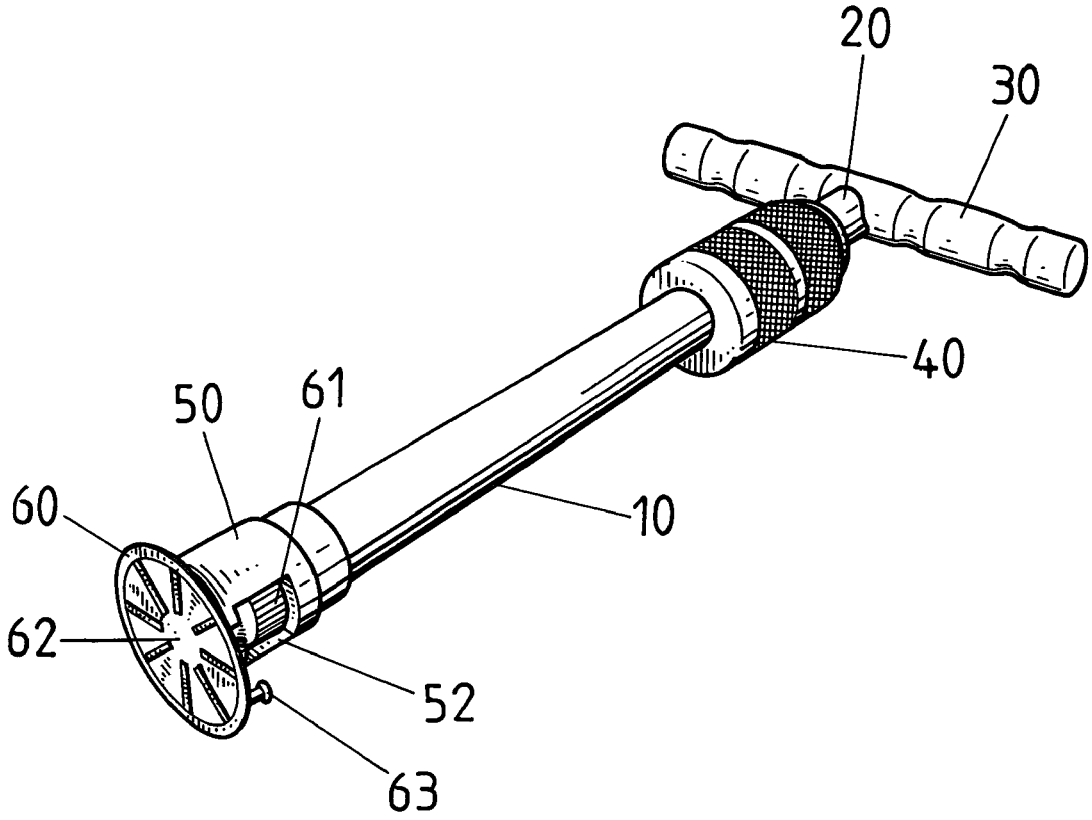
FIG. 1 shows a perspective view of the present invention.
Figure 2:
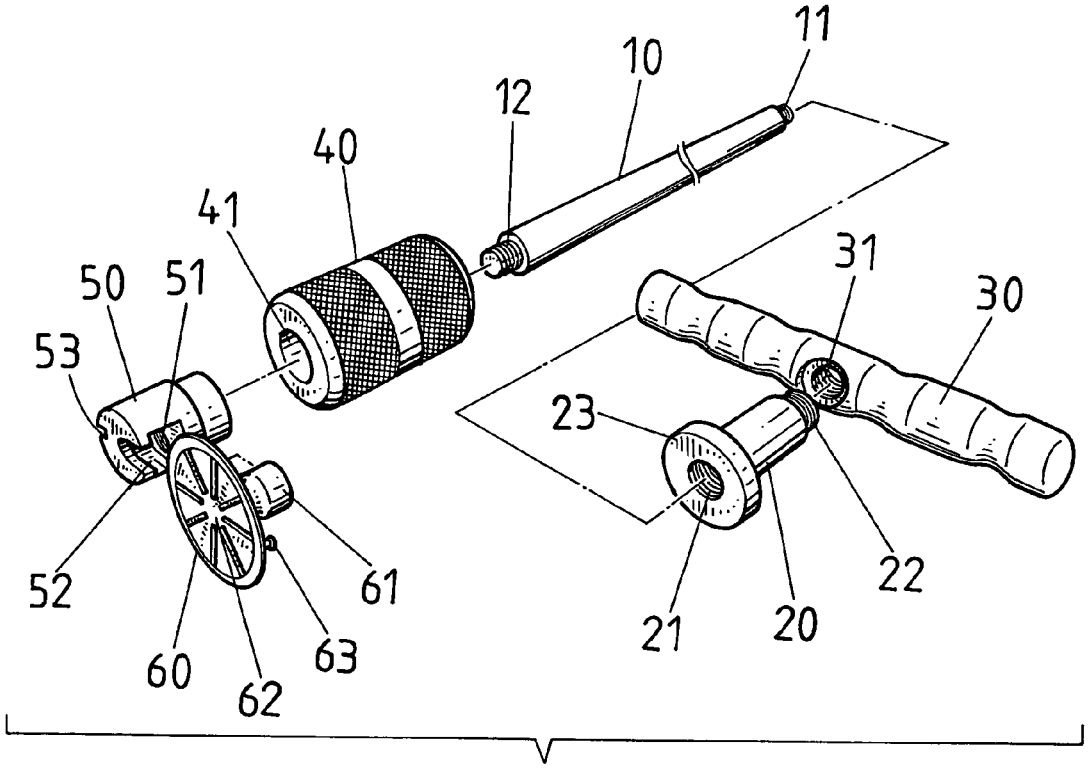
FIG. 2 shows a perspective view of components of the present invention.
Figure 3:
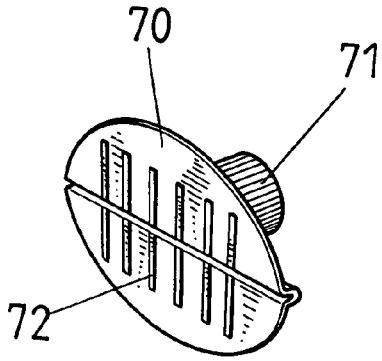
FIG. 3 shows a schematic view of another structure of a repair member of the present invention.

Referring to FIG. 1, FIG. 2 and FIG. 3, which show one embodiment of a repairing kit for automotive dents of the present invention, comprising a straight bar 10, a connecting tube 20, a handle 30, an impact piece 40, a clamp mount 50 and a plurality of repair members 60, 70, 80, wherein two ends of the straight bar 10 are respectively provided with threaded rods 11,12 as end connections.

A threaded hole 21 at one end of the connecting tube 20 enables the threaded rod 11 of the straight bar 10 to be fixed therein, coaxially of which is provided with a stop piece 23. Another end of the connecting tube 20 is provided with a threaded rod end connection 22.

The center of the handle 30 is provided with a threaded hole 31, thereby enabling the threaded rod 22 of the connecting tube 20 to be fixed therein. The impact piece 40 is mounted onto an outer side of the straight bar 10, and is able to slide on the straight bar 10.

A threaded hole 51 defined center of the clamp mount 50 enables the threaded rod 12 of the straight bar 10 to be fixedly screwed therein. Another end of the clamp mount 50 is provided with a mounting socket 52 with a lateral opening on a one side, and another side away from the mounting socket 52 is provided with a release socket 53 having a lateral opening. A mounting pin 61 centrally located on a surface of the repair member 60 releasably engages with a head within the mounting socket 52 of the clamp mount 50. A surface of the repair member 60 opposite the surface with the mounting pin is a contact surface 62 for contacting or bonding to the dent, the rim of which is provided with a release pin 63 with a head adapted to releasably engage laterally into the release socket to facilitate removal of the repair member from a repaired dent.

Figure 4:
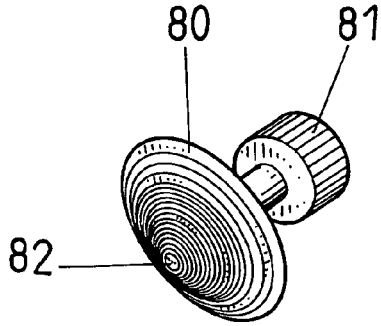
FIG. 4 shows a schematic view of yet another structure of a repair member of the present invention.

Referring to FIG. 3 and FIG. 4, which show repair members 70 and 80 respectively, each of which has a different shaped repair disk surface, and mounting pins 71, 81, located at ends of the repair members 70, 80 respectively can be separately clamped within the mounting socket 52 of the clamp mount 50. The contact surface each of the repair members 70 and 80, designed with a shaped dent 72 or protrusion 82 respectively, are formed to match different shaped automotive dents or bulges.

Figure 5:
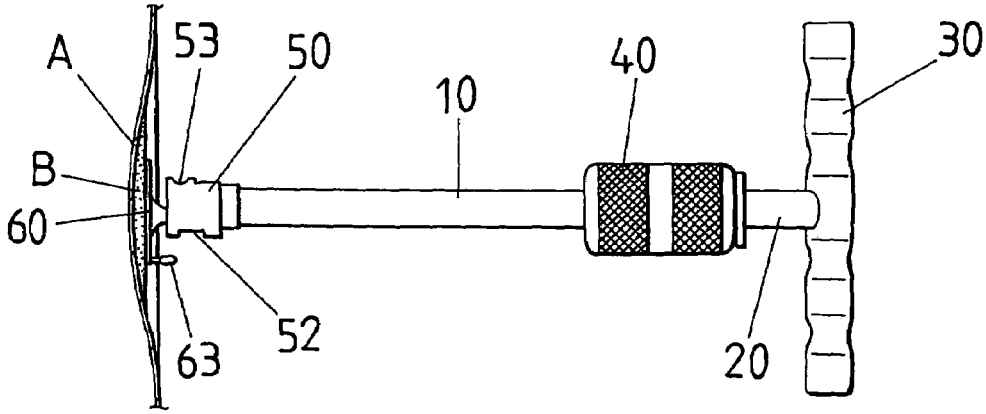
FIGS. 5~9 show schematic views of horizontal motion of the present invention.

Procedural steps to illustrate actions involved to repair automotive dents are described hereinafter:

1. Referring to FIG. 5, the repair member 60 that appropriately matches an automotive dent A is first chosen, and after applying high polymer glue B to the contact surface 62 of the repair member 60, it is rapidly bonded with the dent A area until the dent A area and the contact surface 62 are completely adhered to each other.

Figure 6:
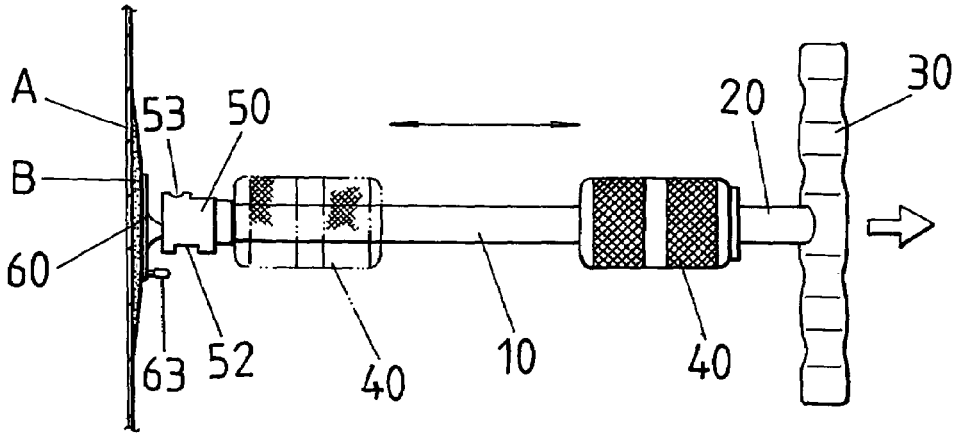

2. Referring to FIG. 6, one hand grasps the handle 30 while the other hand grasps and slides the impact piece 40 towards the rear of the straight bar 10 until it impacts the stop piece 23 of the connecting tube 20. This action is repeated until the dent A area has been completely pulled smooth and restored.

Figure 7:
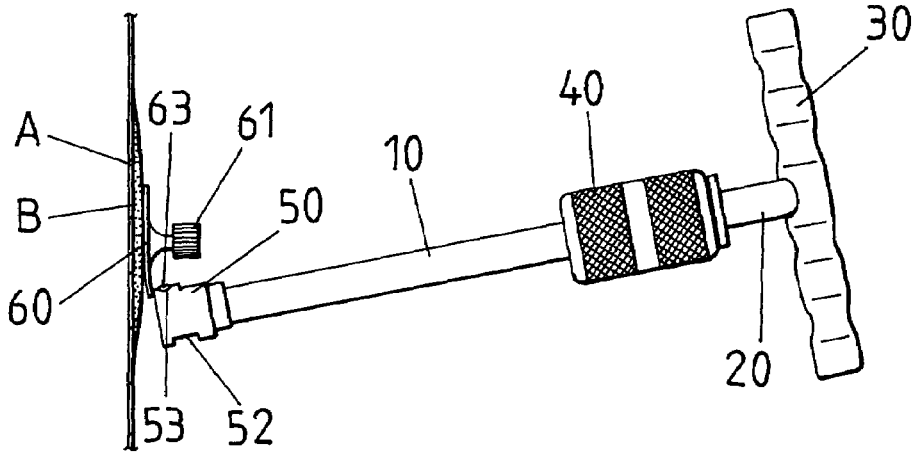

3. Referring to FIG. 7, the clamp hole 53 of the clamp mount 50 is then used to fixedly clamp onto the release pin 63 of the repair member 60 to facilitate detaching the repair member 60 from the high polymer glue B.

Figure 8:
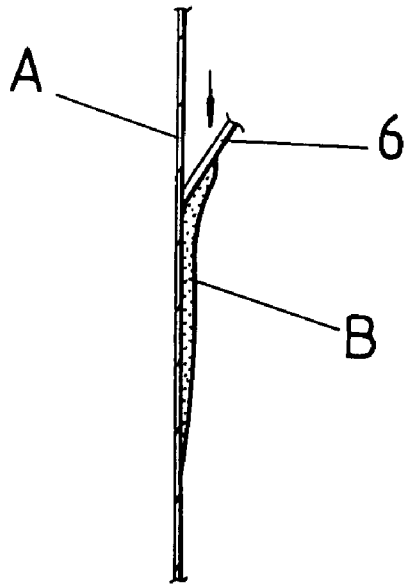

4. Referring to FIG. 8, a drop of cleaning polymer is applied to the residual high polymer glue B, and a plastic knife blade is used to scrape off the residual high polymer glue B.

Figure 9:
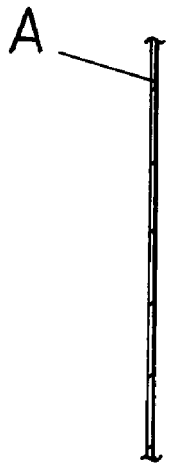

5. Referring to FIG. 9, after repairing, the dent A is practically unnoticeable.

Accordingly, a user can use the present invention to repair automotive dents and restore a smooth surface to an automobile using a DIY (Do It Yourself) method, without having to rely on an auto repair shop, wasting work, time, and money.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A repairing kit for automotive dents, comprising:

a straight bar having a first end and a second end, respectively provided with a first end connection and a second end connection;

a handle;

a connecting tube with a first end connected to a middle of the handle, and a second end of the connecting tube connected to the first end connection of the straight bar, coaxial of which is provided a stop piece;

an impact piece slideably mounted onto an outer axial surface of the straight;

a clamp mount with a first end connected to the second end connection of the straight bar, a second end of the clamp mount having a mounting socket with a lateral opening on one side thereof, and on another side thereof away from the opening of the mounting socket is provided a release socket with a lateral opening;

a generally disk-shaped repair member, having one major surface being a contact surface for contacting or bonding to a dent and a mounting surface opposite to the contact surface, the mounting surface having a central mounting pin adapted to removeably engage laterally into the mounting socket and a release pin located near a rim of the mounting surface, the release pin being adapted to removeably engage laterally into the release socket to facilitate removal of the repair member from a repaired dent;

whereby a structural configuration of aforesaid repair kit enables repairing automotive dents and restoring a smooth surface to an automobile using a Do-It-Yourself method.

2. The repairing kit for automotive dents of claim 1, wherein the straight bar end connections, the connecting rod, and the clamp mount have threaded connections.

* * * * *